US007080717B2

(12) United States Patent
Ito

(10) Patent No.: US 7,080,717 B2
(45) Date of Patent: Jul. 25, 2006

(54) EMERGENCY BRAKE APPARATUS OF ELEVATOR

(75) Inventor: Kazumasa Ito, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/512,947

(22) PCT Filed: Mar. 24, 2003

(86) PCT No.: PCT/JP03/03529

§ 371 (c)(1),
(2), (4) Date: Nov. 1, 2004

(87) PCT Pub. No.: WO2004/085303

PCT Pub. Date: Oct. 7, 2004

(65) Prior Publication Data

US 2005/0126862 A1 Jun. 16, 2005

(51) Int. Cl.

| | |
|---|---|
| ***B66B 5/00*** | (2006.01) |
| ***B66B 5/16*** | (2006.01) |
| ***B66B 5/12*** | (2006.01) |
| ***B66B 5/04*** | (2006.01) |
| ***B65H 59/16*** | (2006.01) |

(52) U.S. Cl. ..... 187/350; 187/351; 187/368; 187/372; 187/374; 187/376; 188/65.1; 188/65.3; 188/72.7

(58) Field of Classification Search ..... 187/350, 187/351, 368, 370, 372, 374, 375, 376, 266; 188/65.1, 65.3, 71.5, 72.7
See application file for complete search history.

(56) References Cited

U.S. PATENT DOCUMENTS

| | | | | |
|---|---|---|---|---|
| 1,738,215 | A * | 12/1929 | Thurston et al. | 187/266 |
| 1,980,230 | A * | 11/1934 | See | 187/357 |
| 3,171,522 | A * | 3/1965 | Petrie et al. | 192/70.28 |
| 3,430,736 | A * | 3/1969 | Long | 188/72.7 |
| 3,662,864 | A * | 5/1972 | Evans | 188/72.2 |
| 4,977,982 | A * | 12/1990 | Bialy et al. | 187/350 |
| 5,096,020 | A * | 3/1992 | Korhonen | 187/376 |
| 5,101,937 | A * | 4/1992 | Burrell et al. | 187/350 |
| 5,202,539 | A | 4/1993 | Lamb | |
| 6,543,596 | B1 * | 4/2003 | Martin et al. | 192/85 AA |
| 6,802,402 | B1 * | 10/2004 | Bausch et al. | 188/171 |

FOREIGN PATENT DOCUMENTS

| | | |
|---|---|---|
| JP | 6-199483 | 7/1994 |
| JP | 7-172725 | 7/1995 |

(Continued)

*Primary Examiner*—Kathy Matecki
*Assistant Examiner*—Eric E. Pico
(74) *Attorney, Agent, or Firm*—Leydig, Voit & Mayer, Ltd.

(57) ABSTRACT

In an elevator emergency braking apparatus, a braking device main body has a main body braking surface facing a main rope and positioned at a first side of a main rope array, and a tapered surface facing the main body braking surface on an opposite side of the main rope array. An intermediate braking piece is disposed between mutually-adjacent main ropes inside the braking device main body. The intermediate braking piece is displaceable in a direction to be placed separably in contact with the main body braking surface. A wedge member is disposed between the tapered surface and the main rope array. The wedge member is separated from the main ropes during normal operation, and wedged between the tapered surface and the main ropes during braking.

10 Claims, 6 Drawing Sheets

FOREIGN PATENT DOCUMENTS

| | | |
|---|---|---|
| JP | 2000-30172 | 1/2000 |
| JP | 2000-322126 | 11/2000 |
| JP | 2002-60152 | 2/2002 |
| JP | 2002-145547 | 5/2002 |
| JP | 2005-312882 | 10/2002 |
| WO | WO 3008317 A1 * | 1/2003 |

* cited by examiner

EMERGENCY BRAKE APPARATUS OF ELEVATOR

TECHNICAL FIELD

The present invention relates to an elevator emergency braking apparatus for braking a car by gripping a main rope suspending the car and a counterweight.

BACKGROUND ART

In conventional elevators, if, for some reason, a car is moved further upward than a normal hoisting zone, a counterweight moves below the normal hoisting zone. Then, the counterweight collides with a counterweight buffer installed in a hoistway floor portion. Thus, mechanical shock from the collision of the counterweight with the hoistway floor portion is buffered, and rising of the car is stopped.

However, if the counterweight collides with the counterweight buffer at a faster speed than a design velocity, the mechanical shock from the collision may not be buffered sufficiently. Thus, methods have been proposed in which safeties for making the counterweight perform an emergency stop when the descent speed of the counterweight (ascent speed of the car) reaches a preset speed are mounted to the counterweight. However, in such methods, it is necessary for space to be secured for installing a speed governor for detecting the speed of the counterweight, and for the safeties for the counterweight, etc., increasing the overall size and expense of the elevator.

Braking apparatuses for stopping the car and the counterweight by gripping a main rope suspending the car and the counterweight have also been proposed, but in braking apparatuses of this type, mechanisms for generating a braking force are large, and constructions for releasing the braking force are complicated, making the machinery expensive.

DISCLOSURE OF THE INVENTION

The present invention aims to solve the above problems and an object of the present invention is to provide an elevator emergency braking apparatus enabling overall size to be reduced.

In order to achieve the above object, according to one aspect of the present invention, there is provided an elevator emergency braking apparatus disposed in an elevator including a main rope array having a plurality of main ropes arranged at a distance from each other, for braking movement of a car by gripping the main ropes, the elevator emergency braking apparatus including: a braking device main body having a main body braking surface facing a main rope positioned at a first side portion of the main rope array, and a tapered surface facing the main body braking surface on an opposite side of the main rope array; an intermediate braking piece disposed inside the braking device main body between a mutually-adjacent pair of the main ropes, being displaceable in such a direction as to be placed separably in contact with the main body braking surface; and a wedge member disposed between the tapered surface and the main rope array so as to be separated from the main ropes during normal operation, and to be displaced in a longitudinal direction of the main ropes and wedged between the tapered surface and the main ropes during braking, wherein the main ropes and the intermediate braking piece are pressed toward the main body braking surface by the wedge member being wedged between the tapered surface and the main ropes.

BEST MODE FOR CARRYING OUT THE INVENTION

Preferred embodiments of the present invention will now be explained with reference to the drawings.

EMBODIMENT 1

Figure 1:
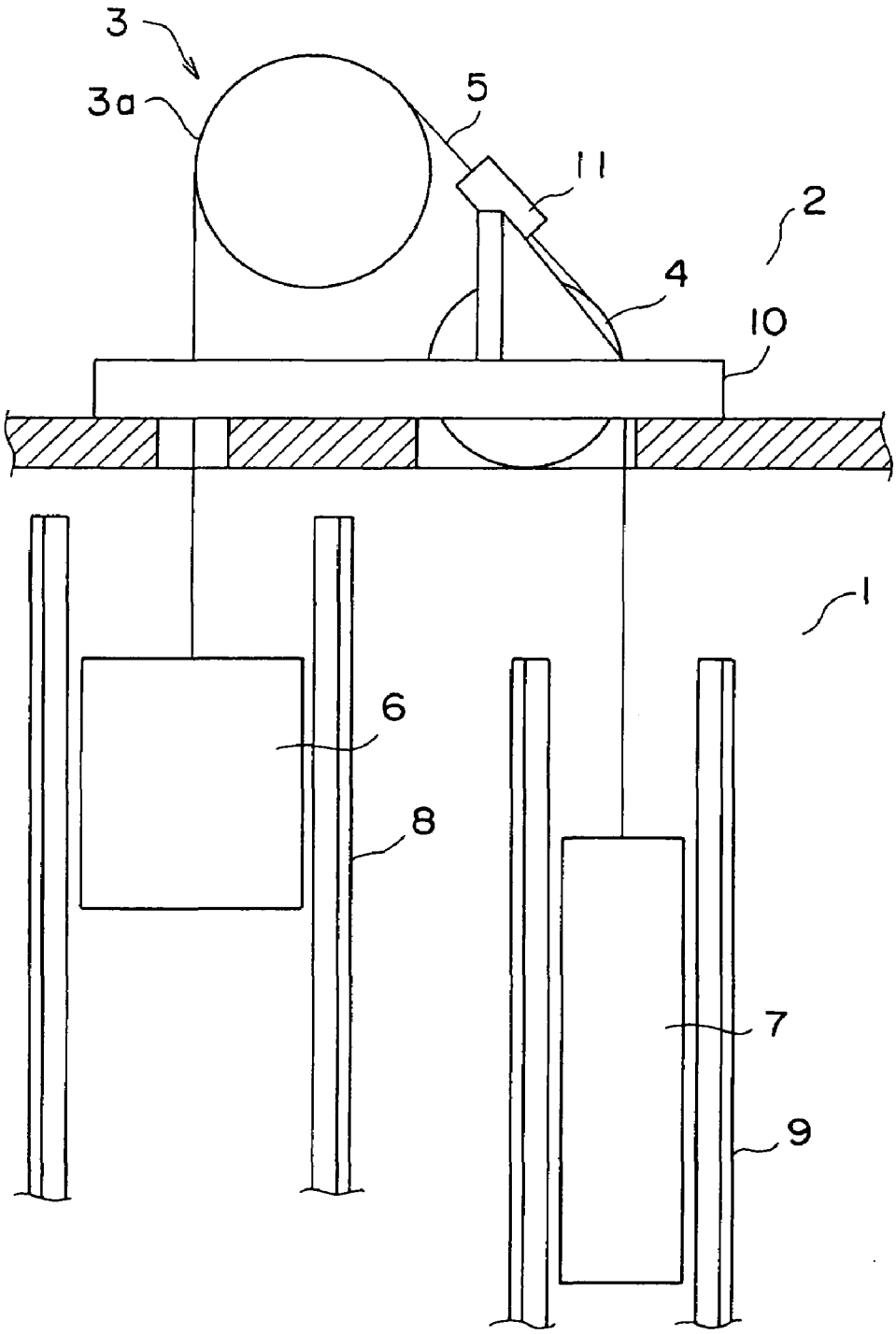
FIG. 1 is a schematic structural diagram showing an elevator according to Embodiment 1 of the present invention.

FIG. 1 is a schematic structural diagram showing an elevator according to Embodiment 1 of the present invention. In the figure, a machine room 2 is disposed in an upper portion of a hoistway 1. A machine base 10 is installed inside the machine room 2. A driving apparatus 3 having a drive sheave 3*a*, and a deflection sheave 4 are supported on the machine base 10. A plurality of main ropes 5 (only one is shown in FIG. 1) are wound over the drive sheave 3*a* and the deflection sheave 4.

A car 6 is suspended by first end portions of the main ropes 5. A counterweight 7 is suspended by second end portions of the main ropes 5. The car 6 and the counterweight 7 are raised and lowered inside the hoistway 1 by a driving force from the driving machine 3. A pair of car guide rails 8 for guiding raising and lowering of the car 6, and a pair of counterweight guide rails 9 for guiding raising and lowering of the counterweight 7 are installed inside the hoistway 1.

An emergency braking apparatus 11 for braking the raising and lowering of the car 6 and the counterweight 7 by gripping the main ropes 5 is mounted onto the machine base 10. The emergency braking apparatus 11 grips the main ropes 5 to one side of the drive sheave 3*a* near the counterweight 7. More specifically, the emergency braking apparatus 11 grips a portion of the main ropes 5 between the drive sheave 3*a* and the deflection sheave 4.

Figure 2:
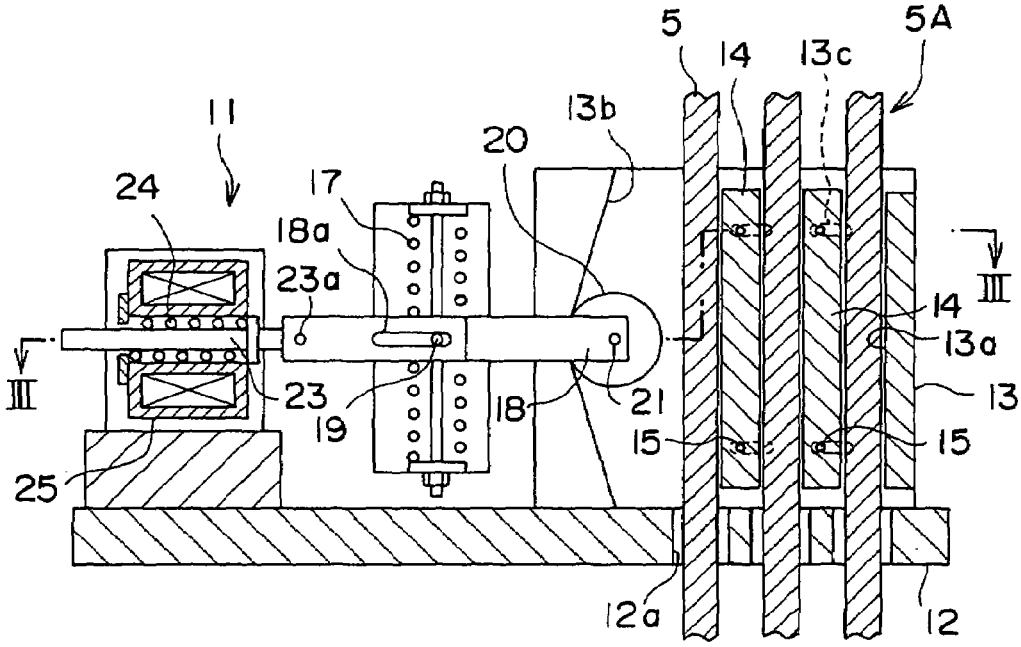
FIG. 2 is a cross section showing a state of an emergency braking apparatus from FIG. 1 during normal operation.
Figure 3:
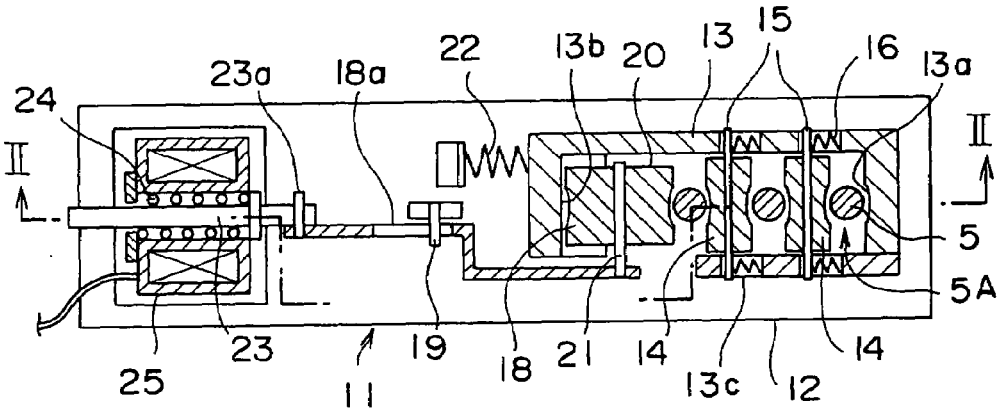
FIG. 3 is a cross section taken along line III—III in FIG. 2.
Figure 4:
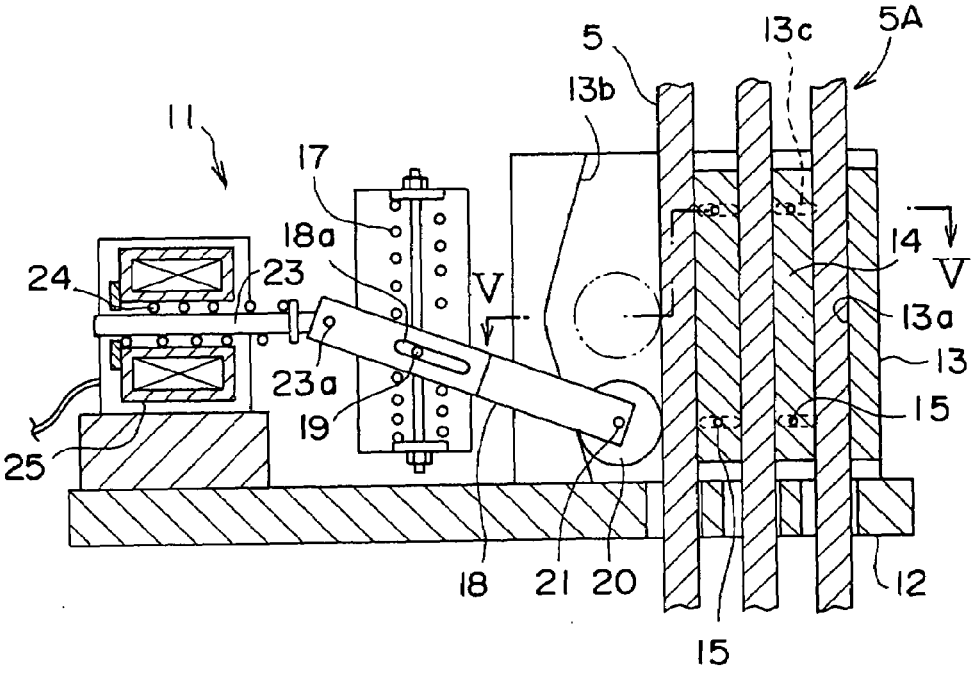
FIG. 4 is a cross section showing a state of the emergency braking apparatus in FIG. 2 during braking.
Figure 5:
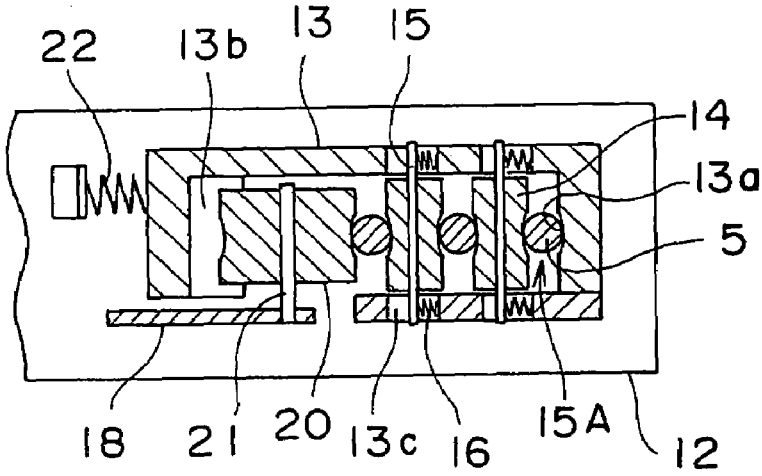
FIG. 5 is a cross section taken along line V—V in FIG. 4.

FIG. 2 is a cross section showing a state of the emergency braking apparatus 11 from FIG. 1 during normal operation, FIG. 3 is a cross section taken along line III—III in FIG. 2, FIG. 4 is a cross section showing a state of the emergency braking apparatus 11 in FIG. 2 during braking, and FIG. 5 is a cross section taken along line V—V in FIG. 4. Moreover, FIG. 2 is a cross section taken along line II—II in FIG. 3.

In the figures, a base 12 is fixed relative to the machine base 10. Three main rope passage apertures 12*a* through which three respective main ropes 5 pass are disposed through the base 12. A main rope array 5A includes a plurality of main ropes 5 (in this case three) arranged at a distance from each other. A braking device main body (housing) 13 enveloping a portion of the main rope array 5A is mounted to the base 12. A main body braking surface 13*a* facing the main rope 5 positioned at a first side portion of the main rope array 5A when viewed in a cross section perpendicular to the main ropes 5 (FIG. 3) is disposed on an inner surface of the braking device main body 13.

The braking device main body 13 is movable in such a direction that the main body braking surface 13*a* is placed separably in contact with the main ropes 5. A position maintaining spring 22 for maintaining the braking device main body 13 at a position in which an extremely small clearance is maintained between the main body braking surface 13*a* and the main ropes 5 is disposed between the braking device main body 13 and the base 12.

A tapered surface 13*b* facing the main body braking surface 13*a* on an opposite side of the main rope array 5A is disposed on the braking device main body 13. In other words, the tapered surface 13*b* faces the main rope 5 positioned at a second side portion of the main rope array 5A when viewed in a cross section perpendicular to the main ropes 5. Furthermore, the tapered surface 13*b* is inclined relative to the main ropes 5 so as to be farthest from the main ropes 5 at an intermediate portion, and to approach the main ropes 5 going from the intermediate portion toward first and second end portions in a longitudinal direction of the main ropes 5.

A plurality of intermediate braking pieces 14 (in this case two) are disposed between mutually-adjacent main ropes 5 inside the braking device main body 13. Specifically, for n main ropes 5, (n-1) intermediate braking pieces 14 are used. The intermediate braking pieces 14 are supported in the braking device main body 13 by means of a plurality of braking piece pins 15. A plurality of braking piece guiding elongated holes 13*c* permitting the braking piece pins 15 to move toward the main body braking surface 13*a* are disposed on the braking device main body 13.

Braking piece springs 16 for forcing the braking piece pins 15 toward the tapered surface 13*b* are disposed in each of the braking piece guiding elongated holes 13*c*. Thus, an extremely small clearance is normally maintained between each of the intermediate braking pieces 14 and the main ropes 5 positioned to first and second sides thereof. In other words, during normal operation, the intermediate braking pieces 14 and the main body braking surface 13*a* do not interfere with the main ropes 5.

A movable arm 18 is supported on the base 12 by means of neutral position maintaining springs 17. During normal operation, the movable arm 18 is maintained by the neutral position maintaining springs 17 at a neutral position extending in a direction at a right angle to the main ropes 5, shown in FIG. 2.

An arm guide slot 18*a* extending in a longitudinal direction is disposed on the movable arm 18. A pivot point pin 19 held by the neutral position maintaining springs 17 is inserted into the arm guide slot 18*a*. The movable arm 18 is capable of reciprocating in such a direction as to be placed separably in contact with the main ropes 5 within a range of a length of the arm guide slot 18*a*.

Figure 6:
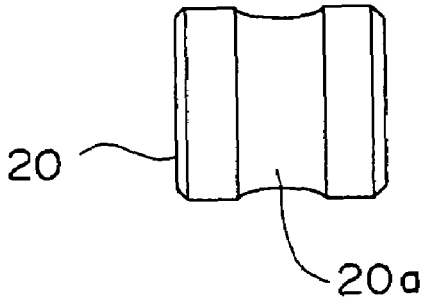
FIG. 6 is a front elevation showing a roller from FIG. 2.

A roller 20 functioning as a wedge member rotatable around a shaft 21 is supported on a tip portion of the movable arm 18 (end portion near the main ropes). During normal operation, the roller 20 is placed in contact with the intermediate portion of the tapered surface 13*b*. A frictional contact surface 20*a* having a coefficient of friction that is high relative to the main ropes 5 is disposed on an outer peripheral surface of the roller 20, as shown in FIG. 6. Frictional force (rotational resistance) between the roller 20 and the shaft 21 is approximately twice that of the spring force of the neutral position maintaining springs 17.

A plunger 23 is coupled to a base end portion of the movable arm 18 so as to be pivotable around a pivoting shaft 23*a*. The plunger 23, the movable arm 18, and the roller 20 are forced toward the main ropes 5 by a braking operation spring 24. A solenoid coil 25 functioning as a separating means for separating the plunger 23, the movable arm 18, and the roller 20 from the main ropes 5 in opposition to the braking operation spring 24 and maintaining them in the normal position is mounted onto the base 12.

Next, operation will be explained. In the normal state, shown in FIGS. 2 and 3, extremely small clearances are maintained between the main body braking surface 13*a* and the main ropes 5, and between the intermediate braking pieces 14 and the main ropes 5. The roller 20 is positioned at the intermediate portion of the tapered surface 13*b*, and is separated from the main ropes 5. Consequently, the main ropes 5 move smoothly without interference from the emergency braking apparatus 11.

If the car 6 rises at a speed faster than a rated speed and reaches a preset overspeed, passage of electric current through the solenoid coil 25 is interrupted. When the passage of electric current through the solenoid coil 25 is interrupted, the plunger 23, the movable arm 18, and the roller 20 are displaced toward the main ropes 5 by the spring force from the braking operation spring 24. Thus, the roller 20 is placed in contact with the main ropes 5 as indicated by the double-dotted chain line in FIG. 4.

If we assume that the main ropes 5 are moving downward in FIG. 4 when the car 6 is rising, then the roller 20 contacting the main ropes 5 is displaced downward in FIG. 4 together with the main ropes 5. At that time, the movable arm 18 is pivoted around the pivoting shaft 23*a*.

As the roller 20 is displaced in the longitudinal direction of the main ropes 5, it is also guided by the tapered surface 20 so as to be displaced in such a direction as to be pressed against the main ropes 5. Thus, the main ropes 5 and the intermediate braking pieces 14 are pressed toward the main body braking surface 13*a*. Then, the roller 20 wedges in between the tapered surface 13*b* and the main ropes 5, as shown in FIG. 4, and stops. At that time, the braking device main body 13 is displaced so as to be drawn slightly toward the plunger 23.

In this state, the main ropes 5 are held between the main body braking surface 13*a* and an intermediate braking piece 14, between two intermediate braking pieces 14, and between an intermediate braking piece 14 and the roller 20. In other words, the main ropes 5 are held between the main body braking surface 13*a* and the roller 20 by means of the intermediate braking pieces 14. Consequently, movement of the main ropes 5 is braked by friction and stopped by the action of the emergency braking apparatus 11.

When the main ropes 5 are grasped by the emergency braking apparatus 11, traction between the drive sheave 3*a* and the main ropes 5 decreases suddenly, and even if the drive sheave 3*a* continues rotating in a direction that raises the car 6, the drive sheave 3*a* slips relative to the main ropes 5, stopping the ascent of the car 6.

When releasing braking by the emergency braking apparatus 11, an electric current is passed through the solenoid coil 25, and the car 6 is lowered to release the wedging of the roller 20. Thus, the plunger 23, the movable arm 18, and the roller 20 are displaced in a direction that separates them from the main ropes 5. At that time, the movable arm 18 is returned to an attitude at a right angle to the main ropes 5 by the neutral position maintaining springs 17.

When the pressing force from the roller 20 onto the main ropes 5 is eliminated, the intermediate braking pieces 14 are returned to their normal positions by the braking piece springs 16, and the braking device main body 13 is also returned to its normal position by the position maintaining spring 22. In other words, braking by the emergency braking apparatus 11 is released automatically and parts constituting the emergency braking apparatus 11 are returned to their normal positions simply by passing an electric current through the solenoid coil 25, and lowering the car 6 slightly.

On the other hand, if the car 6 descends at a set overspeed, safeties (not shown) mounted to the car 6 operate to perform an emergency stop on the car 6.

In an emergency braking apparatus 11 of this kind, because intermediate braking pieces 14 are disposed between mutually-adjacent main ropes 5 such that the main ropes 5 are held between a main body braking surface 13*a* and an intermediate braking piece 14, between two intermediate braking pieces 14, and between an intermediate braking piece 14 and a roller 20 during braking, a large braking force can be obtained while reducing the emergency braking apparatus 11 in size.

In other words, whereas there are only two braking surfaces in a construction simply clamping the main ropes 5 from top and bottom in FIG. 3, in the emergency braking apparatus 11 according to Embodiment 1, there are six braking surfaces, enabling three times as much braking force to be obtained, thereby making the latter adaptable to large capacity elevators. Conversely, only one third (⅓) of the pressing force is required to obtain a braking force equal to that of the related art, enabling overall reductions in size.

In Embodiment 1, three main ropes 5 were used, but if the number of main ropes 5 is increased to four or five, and intermediate braking pieces 14 are disposed between all of the main ropes 5, a braking force of four or five times that of conventional constructions can also be achieved.

In addition, in Embodiment 1, because the tapered surface 13*b* is disposed in first and second longitudinal directions of the main ropes 5 from the intermediate portion of the braking device main body 13, both upward and downward movement of the car 6 can be braked. Consequently, if the car 6 moves in either an upward or a downward direction when the car 6 is at a floor, the car 6 can be stopped immediately by activating the emergency braking apparatus 11.

EMBODIMENT 2

Figure 7:
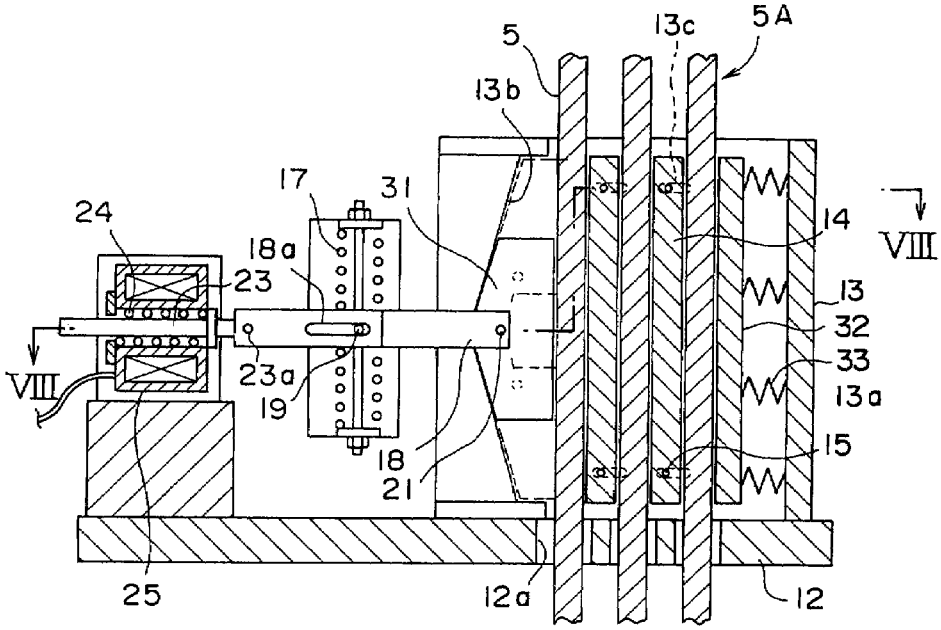
FIG. 7 is a cross section showing a state of an emergency braking apparatus according to Embodiment 2 of the present invention during normal operation.
Figure 8:
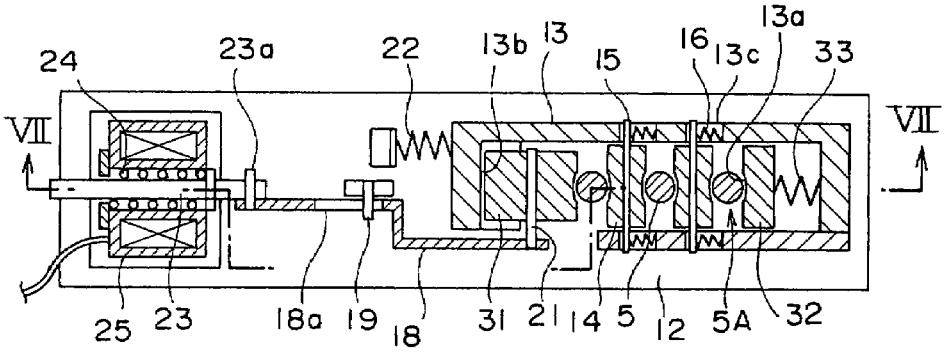
FIG. 8 is a cross section taken along line VIII—VIII in FIG. 7.
Figure 9:
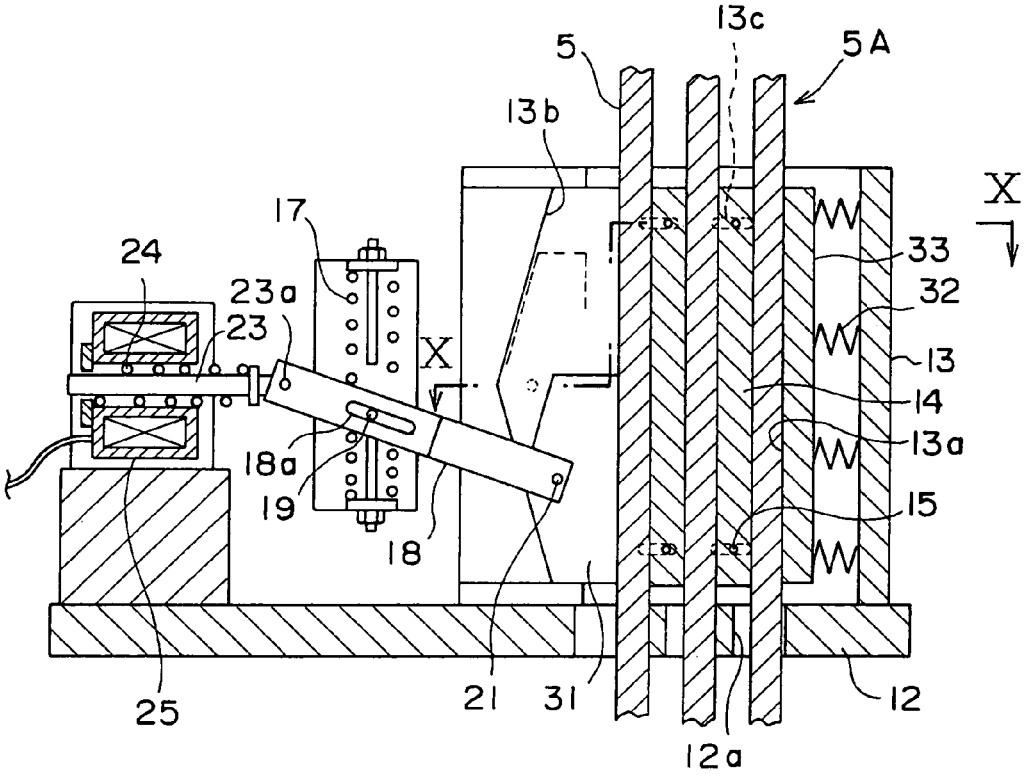
FIG. 9 is a cross section showing a state of the emergency braking apparatus in FIG. 7 during braking.
Figure 10:
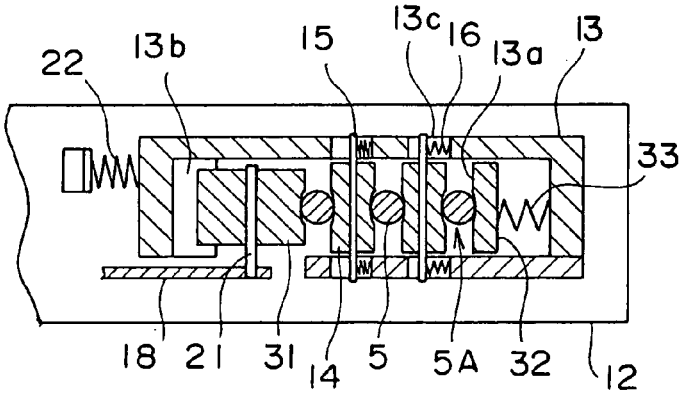
FIG. 10 is a cross section taken along line X—X in FIG. 9.

FIG. 7 is a cross section showing a state of an emergency braking apparatus according to Embodiment 2 of the present invention during normal operation, FIG. 8 is a cross section taken along line VIII—VIII in FIG. 7, FIG. 9 is a cross section showing a state of the emergency braking apparatus in FIG. 7 during braking, and FIG. 10 is a cross section taken along line X—X in FIG. 9. Moreover, FIG. 7 is a cross section taken along line VII—VII in FIG. 8.

In the figures, a wedge member 31 swingable around a shaft 21 is supported on a tip portion of a movable arm 18. A braking device main body 13 has: a braking plate 32 functioning as a braking member; and a plurality of braking plate supporting springs 33 functioning as an elastic body for supporting the braking plate 32. The braking plate 32 has a main body braking surface 13*a* facing a main rope 5 positioned at a first side portion of a main rope array 5A. An amount of compression in the braking plate supporting springs 33 is adjustable, and a braking force generated during braking is adjustable by adjusting the amount of compression in the braking plate supporting springs 33. The rest of the construction is similar to that of Embodiment 1.

In an emergency braking apparatus of this kind, a car 6 can be decelerated and stopped by a preset braking force irrespective of the speed of the car 6. Consequently, the car 6 can be decelerated and stopped at a suitable rate of deceleration.

Moreover, in the above examples, the emergency braking apparatus is disposed between a drive sheave and a deflection sheave, but the disposal of the emergency braking apparatus is not limited to this position. The emergency braking apparatus may also be disposed between the deflection sheave 4 and the counterweight 7, for example.

What is claimed is:

1. An elevator emergency braking apparatus disposed in an elevator apparatus comprising a main rope array including a plurality of main ropes spaced at a distance from each other and arranged side-by-side along a plane from a first rope at a first side of the main rope array to a last rope at a second side of the main rope array, for braking movement of an elevator car by compressing the main rope array, the elevator emergency braking apparatus comprising:

a braking device main body having a main body braking surface facing the first side of the main rope array, and a tapered surface facing the second side of the main rope array;

an intermediate braking piece disposed within the main rope array, between a mutually-adjacent pair of the main ropes, and in a direction toward the first side of the main rope array, compressing the main rope array during braking; and a wedge member disposed between the tapered surface and the second side of the main rope array, separated from the main rope array during normal operation, and displaced in a longitudinal direction of the main ropes and wedged between the tapered surface and the main rope array during braking, in which the main rope array and the intermediate braking piece are compressed and pressed toward the main body braking surface by the wedge member which is wedged between the tapered surface and the main rope array at the second side of the main rope array.

2. The elevator emergency braking apparatus according to claim 1, wherein the tapered surface is inclined relative to the main ropes, is farthest from the main ropes at a central portion, and inclines towards the main ropes along the longitudinal direction of the main ropes, from the central portion.

3. The elevator emergency braking apparatus according to claim 2, further comprising:

a movable arm displaceable in a direction toward the second side of the main rope array, swingable together with displacement of the wedge member in the longitudinal direction of the main ropes, and supporting the wedge member;

a braking operation spring urging the wedge member and the movable arm toward the second side of the main rope array;

separating means for urging the wedge member and the movable arm away from the second side of the main array, in opposition to the braking operation spring; and a neutral position maintaining spring for maintaining the movable arm at a neutral position extending in a direction at a right angle to the longitudinal direction of the main ropes.

4. The elevator emergency braking apparatus according to claim 1, including a braking piece spring urging the intermediate braking piece toward the tapered surface and disposed between the main body braking surface and the intermediate braking piece.

5. The elevator emergency braking apparatus according to claim 1, wherein:

the braking device main body comprises a braking member including the main body braking surface, and an elastic body supporting the braking member;

compression of the elastic body is adjustable; and braking force generated during braking is adjustable by adjusting the compression of the elastic body.

6. An elevator emergency braking apparatus disposed in an elevator apparatus comprising a main rope array having a plurality of main ropes spaced at a distance from each other, for braking movement of an elevator car by gripping the main ropes, the elevator emergency braking apparatus comprising:

a braking device main body having a main body braking surface facing a main rope positioned at a first side of the main rope array, and a tapered surface facing the main body braking surface on an opposite side of the main rope array from the main body braking surface;

an intermediate braking piece disposed inside the braking device main body, between a mutually-adjacent pair of the main ropes, and displaceable in a direction to contact the main body braking surface; and a wedge member disposed between the tapered surface and the main rope array, separated from the main ropes during normal operation, and displaced in a longitudinal direction of the main ropes and wedged between the tapered surface and the main ropes during braking, wherein the main ropes and the intermediate braking piece are pressed toward the main body braking surface by the wedge member which is wedged between the tapered surface and the main ropes during braking.

7. The elevator emergency braking apparatus according to claim 6, wherein the tapered surface is inclined relative to the main ropes, is farthest from the main ropes at a central portion, and inclines towards the main ropes along the longitudinal direction of the main ropes, from the central portion.

8. The elevator emergency braking apparatus according to claim 7, further comprising:

a movable arm displaceable in a direction toward the main ropes, swingable together with displacement of the wedge member in the longitudinal direction of the main ropes, and supporting the wedge member;

a braking operation spring urging the wedge member and the movable arm toward the main ropes;

separating means for urging the wedge member and the movable arm away from the main ropes, in opposition to the braking operation spring; and a neutral position maintaining spring for maintaining the movable arm at a neutral position extending in a direction at a right angle to the main ropes.

9. The elevator emergency braking apparatus according to claim 6, including a braking piece spring urging the intermediate braking piece toward the tapered surface and disposed between the braking device main body and the intermediate braking piece.

10. The elevator emergency braking apparatus according to claim 6, wherein:

the braking device main body comprises a braking member including the main body braking surface, and an elastic body supporting the braking member;

compression of the elastic body is adjustable; and braking force generated during braking is adjustable by adjusting the compression of the elastic body.

* * * * *